US006137442A

United States Patent [19]

Roman et al.

[11] Patent Number: 6,137,442

[45] Date of Patent: Oct. 24, 2000

[54] CHIRPED FIBER GRATING BEAMFORMER FOR PHASED ARRAY ANTENNAS

[75] Inventors: Jose E. Roman, Alexandria, Va.; Michael Frankel, Crofton, Md.; Ronald D. Esman, Burke, Va.

[73] Assignee: The United States of America as represented by the Secretary of the Navy, Washington, D.C.

[21] Appl. No.: 09/058,352

[22] Filed: Apr. 1, 1998

[51] Int. Cl.[7] ..... H01Q 3/22

[52] U.S. Cl. ..... 342/375; 385/37

[58] Field of Search ..... 342/368, 375; 359/140; 385/37

[56] References Cited

U.S. PATENT DOCUMENTS

| | | | |
|---|---|---|---|
| 4,918,751 | 4/1990 | Pessot et al. | 455/608 |
| 5,374,935 | 12/1994 | Forrest | 342/368 |
| 5,461,687 | 10/1995 | Brock | 385/37 |

*Primary Examiner*—Thomas H. Tarcza
*Assistant Examiner*—Dao L. Phan
*Attorney, Agent, or Firm*—Barry A. Edelberg; Sally A. Ferrett

[57] ABSTRACT

A new fiber optic based beamforming architecture for a time steered phased array antenna based on chirped fiber gratings. All of the gratings are identical in length and period chirp so that they all have the same dispersion, thus at a given optical wavelength they have the same time delay. In a preferred embodiment an optical signal is modulated with an RF signal. The RF modulated optical is split and a portion propagates through a length of fiber to a photodetector feeding an antenna array. The second portion of the optical signal is routed through a circulator, which feeds the optical signal to a chirped fiber grating. The grating reflects and delays the optical signal back to the circulator which routes the reflected optical signal to a second coupler. The amount of delay incurred is determined by the grating dispersion and the wavelength of the optical source. The second splits the time delayed optical signal, passing a portion of the time delayed optical signal to the second antenna element and the other portion to other circulators and ultimately to other antenna elements comprising the antenna array. The time delay imposed on the optical signal through the use of chirped fiber gratings controls the relative timing between the antenna elements, thus allowing one to steer the antenna by changing the wavelength of the optical signal.

11 Claims, 3 Drawing Sheets

CHIRPED FIBER GRATING BEAMFORMER FOR PHASED ARRAY ANTENNAS

FIELD OF THE INVENTION

This invention relates in general to optical time delay circuits, and in specific to a new fiber optics based beamforming architecture for time-steered phased array antennas.

BACKGROUND OF THE INVENTION

Optical techniques for time-steered control of phased array antenna have been under intense study in recent years. These techniques allow for squint-free ultrawideband operation of an antenna array, something not possible to achieve with phase-only steering. A common optical technique for time steering is based on the high-dispersion fiber optic prism (FOP) developed by Frankel et al. herein incorporated by reference. Although successful, this technique suffers from some drawbacks, the most obvious being the use of longs lengths of expensive high dispersion fiber, resulting in significant signal latency and a somewhat large optical control unit.

A nearly latency-free and more compact approach to time-steering can be achieved by replacing the high dispersion fiber with fiber gratings. Several beamforming architectures are in the prior art.

Discrete fiber grating beamformers use an optically tunable delay line formed by uniformly stitching a series of fiber Bragg gratings having discrete but different periods. Each grating is phase-matched to a particular wavelength. An antenna array is then formed by feeding each element with a delay line having a grating spacing proportional to the element position. The drawbacks of this scheme are that it requires many gratings, does not allow continuous beamsteering and it requires accurate, precise spacing of the gratings in order to achieve accurate time delays.

Serially fed discrete fiber grating beamformers use a similar technique to that of discrete fiber grating beamformers, but only use a single discrete grating delay line. The elements of the antenna array are controlled by serially gating the optical signal. This technique still suffers from the same drawbacks as the discrete fiber grating architecture, in addition to severely restricting the types of microwave signals that can be handled.

Chirped fiber grating beamformers are an attractive alternative to overcome the stitching and tuning problems encountered with discrete fiber grating beamformers. When using a chirped fiber grating architecture a continuously tunable delay line can be realized with a single chirped grating because the grating period varies continuously along the grating length. Chirped grating beamformers in which every antenna element is fed by a delay line having a different length and chirp have been proposed, however implementation of this beamformer is difficult because it requires long gratings capable of generating nanosecond-range time delays and the gratings must be proportionally matched in length and chirp.

SUMMARY OF THE INVENTION

It is an object of this invention to provide a new phased array antenna beamforming architecture using chirped fiber gratings identical in length and period chirp.

It is also an object of this invention to provide a phased array antenna architecture using chirped fiber gratings of identical length and chirp which allows continuous beamsteering.

It is further object of this invention to provide a new optical delay system using chirped fiber gratings identical in length and period chip which could perform filtering functions.

It is a further object of this invention to provide a phased array antenna which is easier and less costly to build.

These and other objects are achieved by the present invention.

The present invention is a new fiber optic based beamforming architecture for a time steered phased array antenna based on chirped fiber gratings. All of the gratings are identical in length and period chirp so that they all have the same dispersion, thus at a given optical wavelength they have the same time delay. In a preferred embodiment an optical signal is modulated with an RF signal. The RF modulated optical is split and a portion propagates through a length of fiber to a photodetector feeding an antenna array. The second portion of the optical signal is routed through a circulator, which feeds the optical signal to a chirped fiber grating. The grating delays and reflects the optical signal back to the circulator which routes the reflected optical signal to a second coupler. The amount of delay incurred is determined by the grating dispersion and the wavelength of the optical source. The second coupler splits the time delayed optical signal, passing a portion of the time delayed optical signal to the second antenna element and the other portion to other circulators and ultimately to other antenna elements comprising the antenna array. The time delay imposed on the optical signal through the use of chirped fiber gratings controls the relative timing between the antenna elements, thus allowing one to steer the antenna by changing the wavelength of the optical signal.

DETAILED DESCRIPTION

The present invention is a new beamforming architecture for a time steered phased array antenna based on chirped fiber gratings. All of the gratings are identical in length and period chirp so that they all have the same dispersion, thus at a given optical wavelength they provide the same time delay. In operation an optical signal is modulated with an RF signal. The rf modulated optical signal is split and a portion propagates through a length of fiber coupled to a photodetector which feeds a radiating element of the antenna array. The second portion of the optical signal is passed through a circulator, to a chirped fiber grating. The grating reflects the optical signal back through the circulator to a second coupler; the round trip from the circulator to the grating introduces a variable time delay. The second coupler splits the time delayed optical signal, passing a portion of the time delayed optical signal to the second antenna element and a portion to other circulators and ultimately to other antenna elements comprising the array. The time delay imposed on the optical signal through the use of chirped fiber gratings controls the relative timing between the antenna elements in such a manner that the time delay seen by an antenna element is proportional to its position in the array. The relative timing between the antenna elements can be varied by changing the wavelength of the optical signal, thus allowing one to steer the antenna by changing the wavelength of the optical signal.

The basic concept behind this new architecture is the fact that grating dispersion is additive, thus the time delay incurred by an optical signal circulating through n identical gratings of length L and chirp F, is the same as that incurred through a single grating of length nL and chirp F/n, where n is the number of gratings.

Figure 1:
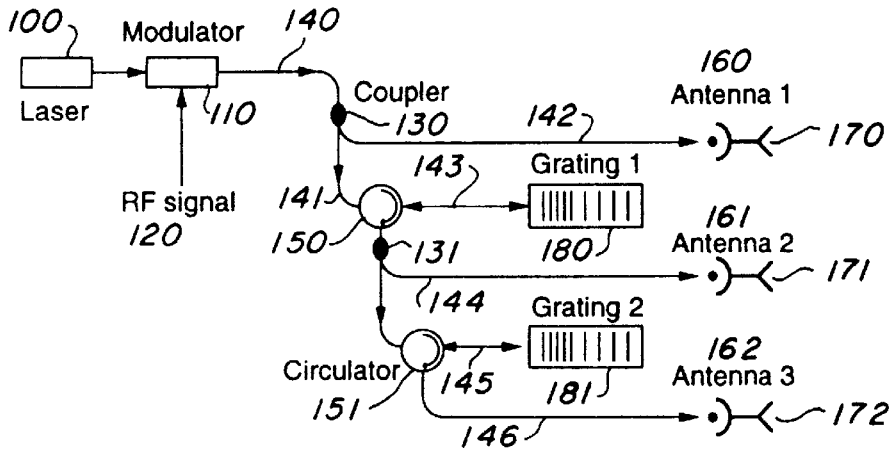
FIG. 1 shows a chirped fiber grating based phased array antenna in which identical reflective gratings are cascaded through optical circulators.

Referring now to the figures wherein like reference characters indicate like elements throughout the views, FIG. 1 discloses a preferred embodiment of the chirped fiber grating based beamformer. In the figures a 3 element array is depicted, however the beamforming architectures disclosed are easily scalable to hold a larger number of elements. A wavelength tunable laser source, 100 is coupled to modulator 110 which is also coupled to RF signal source 120. Modulator 110 is coupled to an optical coupler 130 preferably by means of an optical fiber 140. Coupler 130 is also coupled to an optical circulator 150 and antenna means 160 preferably via a lengths of optical fiber 141, 142. Antenna means 160 comprises a photodetector with radiator probes (not shown), or other structure capable of detecting an optical signal propagating in fiber 142 from coupler 130 and converting the detected optical signal to an rf electrical signal. The rf electrical signal is coupled to an antenna element 170 capable of radiating electromagnetic signals. Circulator 150 is coupled to chirped fiber grating 180, preferably via a length of optical fiber 143. Circulator 150 is also coupled to a second coupler 131. Coupler 131 is coupled to a second antenna means 161, identical to antenna means 160, having a structure capable of detecting an optical signal, converting that optical signal to an rf electrical signal, and radiating through antenna element 171. Coupler 131 is coupled to circulator 151, which is coupled to a second chirped fiber grating, 181, preferably via a length of optical fiber 145.

Chirped fiber gratings 180 and 181 are identical in length and period chirp, so they have the same dispersion. Thus, for a given optical wavelength, all the gratings provide the same time delay to the optical signal. Gratings 180, 181 can have either positive or negative dispersion. Circulator 151 is coupled to antenna means 162, identical to antenna means 160 and 161.

In operation, laser source 100 generates an optical signal which is modulated with the rf signal produced by rf source 120 feeding modulator 110. The modulated optical signal propagates through fiber 140 to coupler 130, which divides the modulated optical signal, allowing a portion of the optical signal to propagate through fiber 142 to antenna means 160, the remaining signal propagates through fiber 142 into optical circulator 150. The modulated optical signal which is propagating through fiber 142 is received at antenna means 160, and a photo detector detects the modulated optical signal and causes antenna element 170 to radiate, the rf output having a linear relationship with the modulated optical signal, which shares a linear relationship with rf signal source 120.

Coupler 130 couples the remaining optical signal to optical circulator 150. Circulator 150 feeds grating 180 through fiber 143 and routes the reflected signal to coupler 131, thus preventing the reflected light from passing backwards through the system. The optical signal incident on grating 180 is reflected back to circulator 150 with a time delay given by:

$$D_g(\lambda - \lambda_0) + \frac{NL}{c}$$

where $D_g$ is the grating dispersion (ps/nm), $\lambda$ is the wavelength of the optical signal, $\lambda_0$ is the center wavelength of the grating reflection spectrum, N is the effective index of the guided mode, and L is the grating length. The transmitted component (if any) of the optical signal through the grating undergoes a constant time delay NL/c.

Circulator 150 then allows the reflected optical signal to propagate to coupler 131, which divides the reflected optical signal allowing a portion of the reflected optical to propagate to antenna means 161 through fiber 144. Antenna means 161 is identical to antenna means 160 and produces an rf output at antenna element 171 that is time delayed with respect to the rf output at antenna element 170. Referring again to coupler 131 the remaining portion of the optical signal propagates to circulator 151, which couples the optical signal from coupler 131 to a second grating 181 through fiber 145. The optical signal incident on grating 181 receives a further time delay, with respect to the optical signal propagating in fiber 144 and propagates back through fiber 145 to circulator 151 and through fiber 146 to antenna means 162, where it produces an rf output at antenna element 172 that is delayed with respect to the rf output at antenna element 171. In all embodiments, the time delay for the nth antenna element is given by:

$$(n-1)D_g(\lambda-\lambda_0)+C(n)$$

where C(n) is a constant, hence the time delay is proportional to the antenna element.

Thus, through the use of chirped fiber grating of identical length and chirp, each antenna element 170, 171 and 172 which comprises the phased array generates an rf signal time-delayed with respect to the other antenna elements which comprise the array. This structure, by employing cascaded chirped fiber gratings facilitates the synchronization necessary for successful steering of the phased array antenna. Since chirped fiber gratings delay an optical signal propagating therethrough, as a function of the optical wavelength, the antenna beam may be steered by altering the wavelength of the optical signal produced by the laser source, which in turn alters the relative timing between the antenna elements. By employing identical chirped fiber gratings (i.e., they have the same nominal length and chirp), the time delay to the antenna elements may be increased by circulating the signal through an increasing number of identical gratings. This feature eliminates the need for gratings of different lengths, thus requiring only one phase masks, rather than several mask, necessary to fabricate gratings of different lengths and chirps. Since a single phase mask may be used to fabricate all gratings used in the disclosed structure, fabrication errors are minimized.

Figure 2:
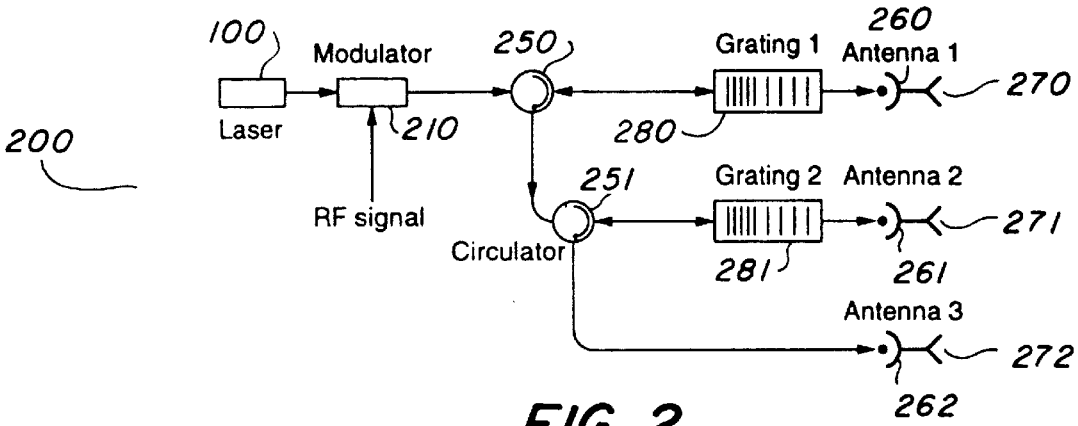
FIG. 2 shows a chirped fiber grating based phased array antenna in which partially transmitting identical gratings are cascaded through individual optical circulators.

Referring now to FIG. 2 which shows an embodiment of a chirped fiber phased array antenna in which partially transmitting gratings 280, 281 are cascaded through individual optical circulators 250, 251. In this embodiment the transmitting components are directly fed to antenna means 260, 261, and 262. Modulator 210 is directly coupled to circulator 250, which is coupled to grating 280 and a second circulator, 251. Grating 280 is directly coupled to antenna means 260. Circulator 251 is coupled to grating 281, which is directly coupled to antenna means 261 effective to allow an optical signal to propagate through circulator 251 to grating 281, through grating 281 and to antenna means 261. Circulator 251 is also directly coupled to antenna means 262.

Partially transmitting grating 280 imposes a time delay on the optical signal propagating therethrough reflecting the delayed optical signal back to circulator 250. Optical circulator 250, coupled to a second circulator 251, directs the reflected, time delayed optical signal, to a second grating 281, which transmits a portion of the delayed signal to antenna means 261. Grating 281 causes a second delay on the optical signal and reflects a portion of the further delayed optical signal, back to circulator 251 which is directly coupled to antenna means 262.

The optical signal, now containing a second time delay generated by interaction with gratings 280 and 281, respectively, propagates from circulator 251 to antenna means 262, which in turn produces a modulate rf output in antenna element 272 time delayed with respect to the output of antenna element 271 which in turn is time delayed with respect to the rf output of antenna element 270.

By employing partially reflective gratings this and similar structures eliminate the need for couplers, and simplifies grating fabrication as 100% reflectivity is not required.

Figure 3:
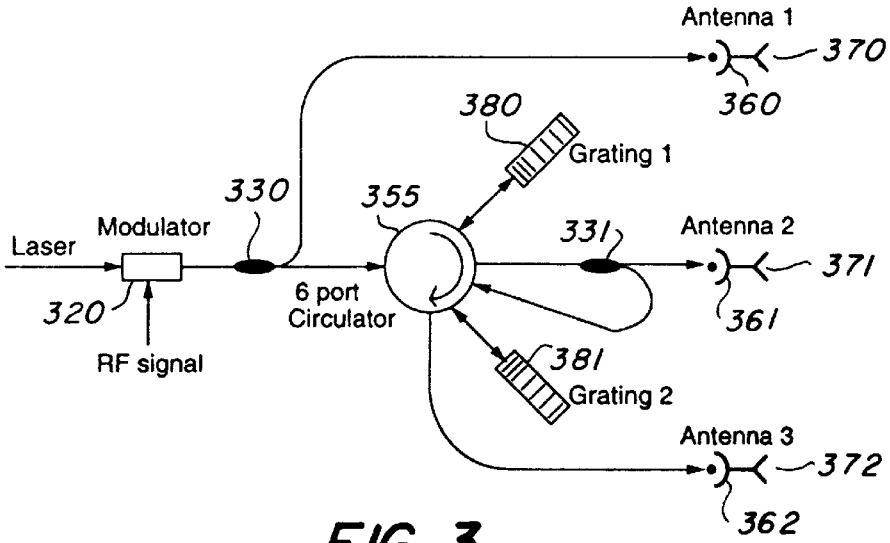
FIG. 3 shows a phased array antenna structure employing highly reflecting chirped fiber gratings using a multiple port optical circulator.

Referring now to FIG. 3, which shows an embodiment of the chirped fiber grating phased array antenna using a single circulator. In this embodiment gratings 380, 381 are cascaded through a multiple port circulator 355. While this embodiment illustrates a phased array employing only 3 antenna elements 370, 371 and 372 and one multi port circulator 355 the design may be easily expanded to employ a larger number of antenna elements.

In the embodiment illustrated in FIG. 3, modulator 320 is coupled to a 6-port circulator 355, via coupler 330. The gratings 380, 381 are highly reflecting. Antenna means 360, coupled to modulator 320 by coupler 330 receives a portion of the undelayed modulated optical signal, split by coupler 330, which is photo detected and fed to antenna element 370. The remainder of the optical signal split by coupler 330, propagates to circulator 355, which directs the light to reflective grating 380. Grating 380 reflects the optical signal back to circulator 355. The reflected optical signal received by circulator 355 from grating 380 has been time delayed with respect to the optical signal received by grating 380. Coupler 331 receives the optical signal delayed by grating 380, couples a portion of the signal to antenna means 361, and returns a portion of the optical signal back to circulator 355.

Antenna means 361, receives the optical signal from coupler 331 and generates an rf signal time delayed with respect to the optical signal received by antenna means 360. Grating 381 coupled to circulator 355, receives the optical signal from circulator, delays it and returns the optical signal, now delayed a second time, to circulator 355 which is also coupled to antenna means 362. Antenna means 362 receives the optical signal, now containing a time delay generated from gratings 380 and 381 through circulator 355 and generates an rf signal via antenna element 372 which is time with respect to the emissions at antenna elements 370 and 371.

Thus through the use of a multiple port circulator instead of individual circulators this embodiment provides a reduced loss and a compact cost effective way of distributing the signals to the antenna elements.

Figure 4:
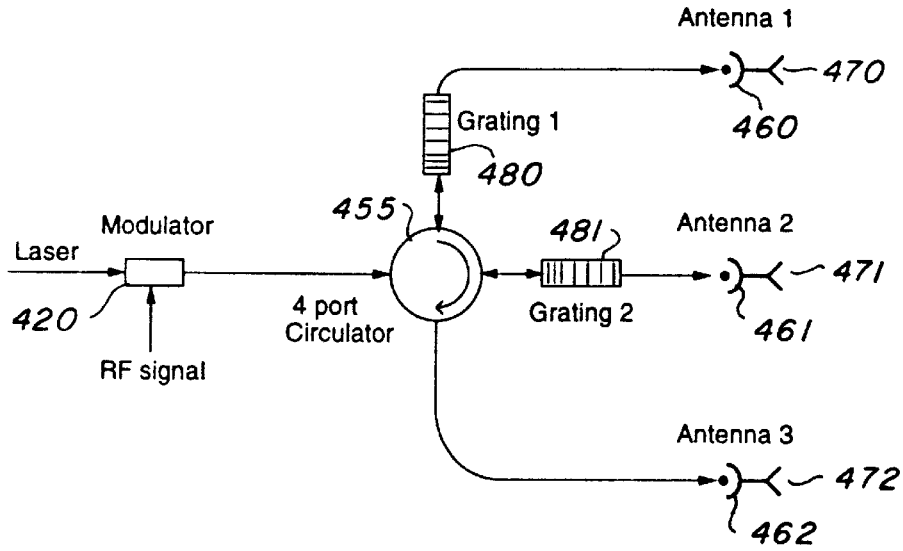
FIG. 4 shows a phased array antenna structure employing partially transmitting chirped fiber gratings employed in combination with a multiple port circulator.

Referring now to FIG. 4, which shows a further embodiment of the disclosed invention. In this embodiment, partially reflecting chirped fiber gratings 480, 481 are employed in combination with a multi port circulator 455.

Referring again to FIG. 3, for purposes of example, an antenna using the structure defined in this embodiment would employ commercial gratings, fabricated from a holographically written phase mask, having peak 98% reflection at 1556 nm, a length of 3.4 cm, and a chirp of 1.2 nm/cm.

A wavelength-tunable semiconductor is used as the optical source. Modulator 320 is a wideband electro-optic Mach-Zehnder modulator, (MZM), which amplitude modulates the optical carrier with an RF signal. Overall delays from each tap are equalized to within $\mp 1$ ps at the grating center wavelength of $\lambda_0$=1556 nm using additional non-dispersive fiber. Thus, the overall time delay at each optical tap is linearly related to the sequential tap number and to the wavelength de-tuning from the center wavelength. Fiber-optic attenuators are used to equalize the amplitudes of the tapped signals to within 0.2 dB.

Antenna means 360, 361, and 362 form a microwave D-lens. The example microwave D-lens used for the pattern measurements was designed for ~3.2 GHZ center frequency operation but provided adequate performance over the 3.0 to 3.8 GHz frequency range. It consisted of a parallel plate waveguide with a series of 34 RF emitter probes arranged on a half circle with a 0.508 m radius. A similar series of RF receiver probes are arranged along the half-circle base. The emitter probes are separated by a $\pi/17$ radian arcs and the receiver probes by $\lambda/2$ at 3.2 GHz (~0.047 m).

Figure 5:
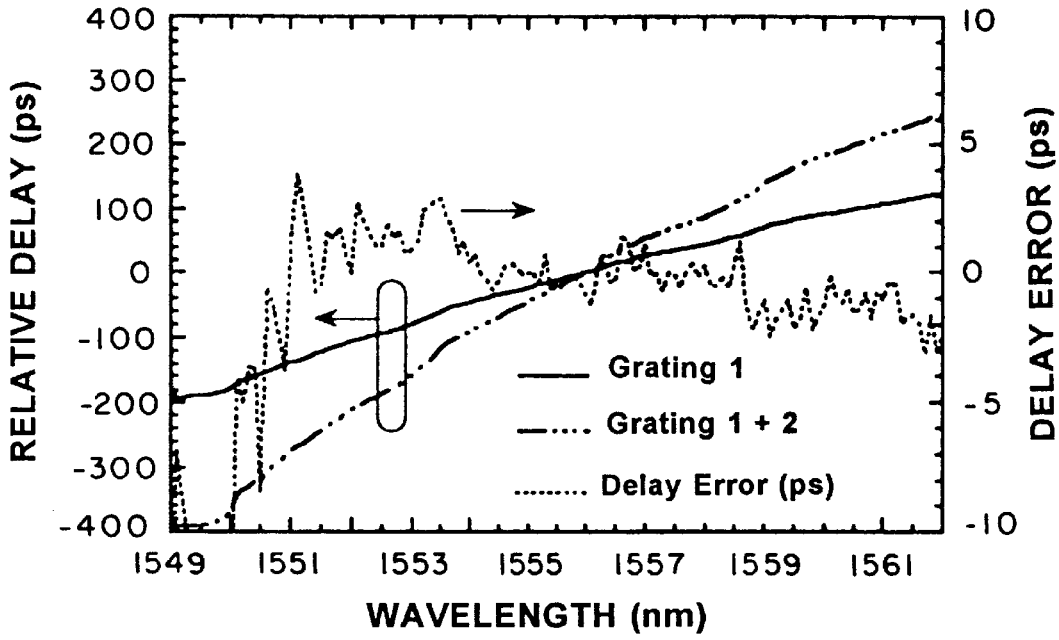
FIG. 5 is a plot of the measured grating delay characteristics.

FIG. 5 illustrates the grating delay characteristics, measuring the rf throughput with a network analyzer directly following the photodetectors contained in antenna means 361 and 362. The grating characteristics are matched to $\mp 2$ ps over the wavelength range of 1551 to 1561 nm as measured at 12 GHz. The maximum measured delays were 320 ps for a single grating and 640 ps for two cascaded gratings.

Figure 6:
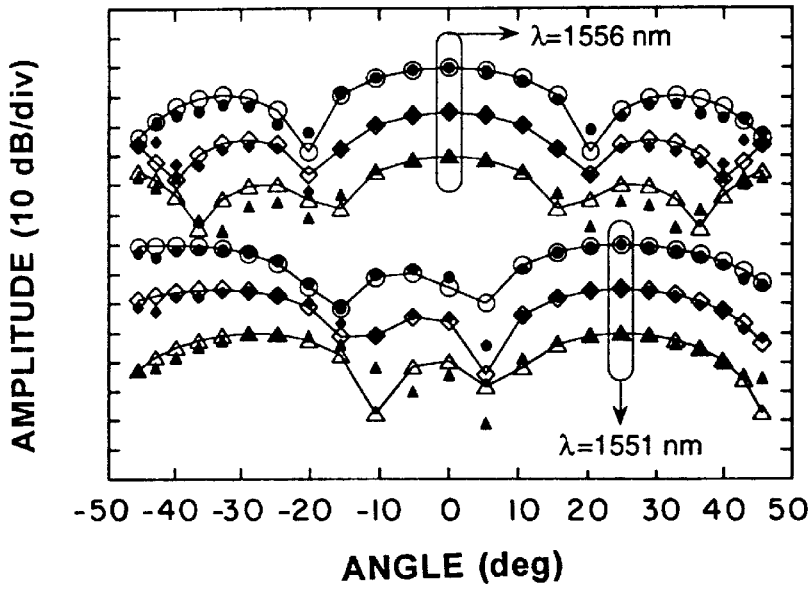
FIG. 6 shows the antenna radiation patterns measured at 3.0 GHz, 3.3 GHz, and 3.6 GHz for three antenna elements arranged in a D-waveguide configuration.

FIG. 6 shows the signals measured at 3.0 GHZ (depicted by circles), 3.3 GHZ (diamonds), and 3.6 GHZ (triangles) across the D lens focal plane. The frequency responses have been offset for clarity so the reader can observe the expected narrowing of the main lobe with increasing frequency.

Broadband steering of the antenna, is accomplished simply by tuning the laser wavelength. Tuning the wavelength to $\lambda$=1551 nm, introduces a 137 ps delay between consecutive taps, as determined from FIG. 5, which corresponds to the main beam being steered to +25°, as can be observed in FIG. 6.

The use of a structure employing chirped fiber gratings of identical length also provides for minimal signal latency. The dispersion (28 ps/nm) of the 3.4 cm long (340 ps nominal delay) gratings used in the example beamformer is roughly equivalent to 300 m (1.5 $\mu$s nominal delay) of the dispersion compensating fiber used in the dispersive fiber beamformers. Furthermore, due to their relatively short length the gratings used in this structure cost significant less to fabricate than dispersive fiber or long gratings used by the prior art.

Figure 7:
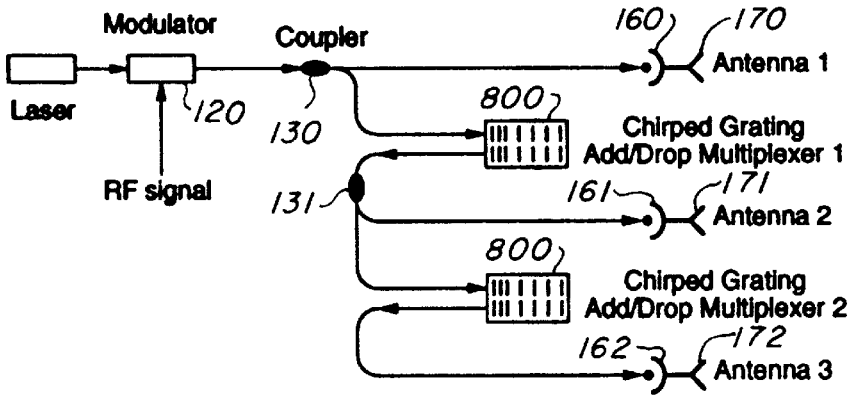
FIG. 7 shows a phased array structure of FIG. 1, replacing circulators with a chirped fiber grating add/drop multiplexer.
Figure 8:
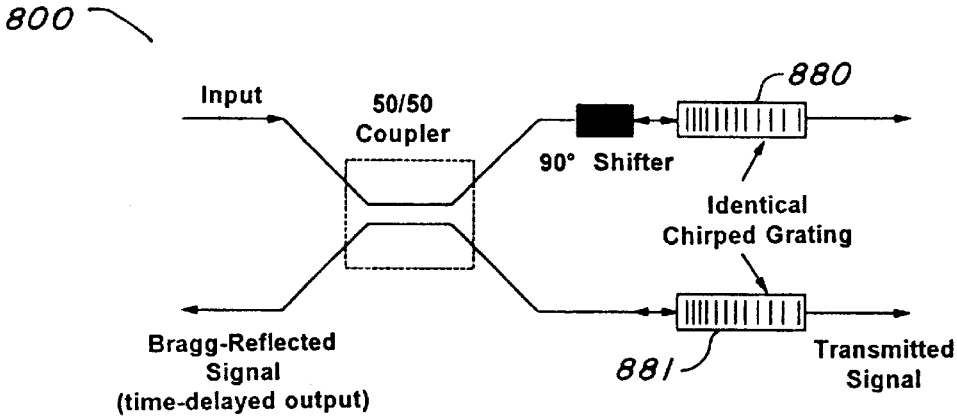
FIG. 8 shows a chirped grating add/drop multiplexer which functions like an optical circulator.

Other embodiments of the disclosed chirped fiber grating structure are possible. Referring to FIG. 7, which employs a phased array structure similar to that disclosed to FIG. 1, replacing circulators 150 and 151 with a chirped grating add/drop multiplexer as shown in FIG. 8. This device is an all-fiber (or planar) Mach-Zehnder interferometer that functions like an optical circulator. Two identical chirped gratings 880 and 881 are recorded on the arms of the interferometer. The optical phase of one arm is tuned, by phase shifter 822, so that substantially all of the reflected signal emerges at one arm of the interferometer. The advantage of this configuration is its lower insertion loss (0.1 dB/pass) compared to that of an optical circulator (~0.5 dB/pass). The lower insertion loss allows a larger number of elements in the array.

Obviously, many modifications and variations of the present invention are possible in light of the above teachings. For example the structure disclosed in FIG. 2 may be employed using chirped fiber add/drop multiplexers, as shown in FIG. 8 rather than optical circulators, or the invention may be practiced with using a phased array with a multitude of radiating elements.

Furthermore, it is well recognized in the field that the functions of an antenna array is analogous to a finite impulse response filter. Hence, the fiber optic variable time delay networks disclosed could be modified to perform filtering functions. In particular, the plurality of signals could be reconfigured optically or (after photodetection) electrically as one ore more outputs. That is, after photodetection, the output rf signal would be a filtered version of the input rf signal. This modification may be employed on other devices, such as optical filters useful for microwave communication networks or other applications in which an optical time delay is useful.

It is therefore understood that, within the scope of the appended claims, the invention may be practiced otherwise than as specifically described.

What is claimed is:

1. A fiber optic based phased array antenna comprising:

means for producing an optical signal, means for modulating said optical signal with an rf signal, means for dividing said modulated optical signal, said means for dividing said optical signal splitting said optical signal into a plurality of component optical signals, means for time delaying at least one of said plurality of component optical signals comprising chirped fiber gratings of identical length and chirp, an antenna array, said antenna array comprising a plurality of radiating elements, means for coupling each of said plurality of optical signals with a corresponding radiating element;

wherein each of said radiating elements produce an electromagnetic signal, the timing of said electromagnetic signal produced by each of said radiating elements being controlled by the time delay of said optical signal coupled to said corresponding radiating element.

2. A fiber optic based phased array antenna structure comprising:

means for dividing an optical signal into a plurality of component optical signals, means for time delaying select components of said optical signal, said means for time delaying said select components, comprising chirped fiber gratings, said gratings disposed to allow passage of select components of said optical signal through select combinations of identical chirped fiber gratings to effect a distinct time shift on said corresponding component optical signal, a plurality of radiating elements, means for coupling each of said plurality of component optical signals with a corresponding radiating element.

3. A fiber optic based phased array antenna comprising:

means for dividing an optical signal into a plurality of component optical signals, means for time delaying select components of said optical signal, said means for time delaying said select components, comprising chirped fiber gratings, said gratings disposed to allow passage of select components of said optical signal through select combinations of identical chirped fiber gratings to effect a time shift on said corresponding component optical signal, a plurality of radiating elements, means for coupling each of said plurality of component optical signals with a correspond radiating element;

wherein each of said radiating elements produce an electromagnetic signal, the timing of said electromagnetic signal produced by each of said radiating elements being controlled by the time delay of said optical signal coupled to said corresponding radiating element.

4. The device of claim 1 wherein said means for producing an optical signal is a variable wavelength laser.

5. The device of claim 1, wherein said antenna is steered by changing the wavelength of said optical signal.

6. The structure of claim 2, wherein said chirped fiber gratings are partially reflective, and wherein said means for coupling is disposed effective to cause light passing through each of said chirped fiber gratings to be input to a respective one of said plurality of radiating elements.

7. The structure of claim 2, wherein said chirped fiber gratings are partially reflective, and wherein said means for coupling is disposed effective to cause light reflected from each of said chirped fiber gratings to be input to a respective one of said plurality of radiating elements.

8. The device of claim 1, wherein said means for dividing said modulated optical signal is an optical coupler.

9. The device of claim 1, wherein said means for dividing said modulated optical signal is an optical circulator.

10. The device of claim 1, wherein said means for dividing and means for time delaying is a chirped grating add/drop multiplexer.

11. The device of claim 1, where in said modulator is a Mach-Zehnder modulator.

* * * * *